US005969286A

United States Patent [19]

Ward et al.

[11] Patent Number: 5,969,286

[45] Date of Patent: Oct. 19, 1999

[54] LOW IMPEDENCE SLAPPER DETONATOR AND FEED-THROUGH ASSEMBLY

[75] Inventors: Michael A. Ward, Pasadena, Md.; David L. Overman, Punta Gorda, Fla.

[73] Assignee: Electronics Development Corporation, Columbia, Md.

[21] Appl. No.: 08/979,971

[22] Filed: Nov. 26, 1997

Related U.S. Application Data

[60] Provisional application No. 60/033,349, Nov. 29, 1996.

[51] Int. Cl.[6] ..... F42C 19/12; F42B 3/198; F42B 3/12

[52] U.S. Cl. ..... 102/202.7; 102/202.14

[58] Field of Search ..... 102/202, 202.5, 102/202.7, 202.9, 202.14, 206, 204, 200, 530; 29/829, 830, 837, 840, 843

[56] References Cited

U.S. PATENT DOCUMENTS

| | | | |
|---|---|---|---|
| H1366 | 11/1994 | Bickes, Jr. et al. | 102/202.5 |
| 3,366,055 | 1/1968 | Hollander, Jr. | 102/202.5 |
| 3,882,323 | 5/1975 | Smolker et al. | 102/202.5 |
| 4,471,697 | 9/1984 | McCormick et al. | 102/202.14 |
| 4,484,523 | 11/1984 | Smith et al. | 102/202.5 |
| 4,602,565 | 7/1986 | MacDonald et al. | 102/202.7 |
| 4,621,578 | 11/1986 | Vallieres et al. | 102/202.9 |
| 4,708,060 | 11/1987 | Bickes, Jr. et al. | 102/202.7 |
| 4,729,315 | 3/1988 | Proffit et al. | 102/202.9 |
| 4,788,913 | 12/1988 | Stroud et al. | 102/202.5 |
| 4,819,560 | 4/1989 | Patz et al. | 102/202.5 |
| 4,831,933 | 5/1989 | Nerheim et al. | 102/202.5 |
| 4,840,122 | 6/1989 | Nerheim | 102/202.5 |
| 4,843,964 | 7/1989 | Bickes, Jr. et al. | 102/202.5 |
| 4,852,493 | 8/1989 | Boberg et al. | 102/202.5 |
| 4,862,803 | 9/1989 | Nerheim et al. | 102/202.5 |
| 4,869,170 | 9/1989 | Dahmberg et al. | 102/202.5 |
| 4,924,774 | 5/1990 | Lenzen | 102/202.7 |
| 4,928,595 | 5/1990 | Weingart | 102/202.7 |
| 4,938,137 | 7/1990 | Guay | 102/202.7 |
| 4,944,225 | 7/1990 | Barker | 102/202.5 |
| 4,976,200 | 12/1990 | Benson et al. | 102/202.7 |
| 5,029,529 | 7/1991 | Mandigo et al. | 102/202.9 |
| 5,052,301 | 10/1991 | Walker | 102/202.7 |
| 5,064,382 | 11/1991 | Minnis | 439/395 |
| 5,074,035 | 12/1991 | Tyznik | 29/830 |
| 5,080,016 | 1/1992 | Osher | 102/202.7 |
| 5,088,413 | 2/1992 | Huber et al. | 102/202.5 |
| 5,092,237 | 3/1992 | Beaufay et al. | 102/531 |
| 5,113,764 | 5/1992 | Mandigo et al. | 102/202.9 |
| 5,195,898 | 3/1993 | Mary | 439/77 |
| 5,204,491 | 4/1993 | Aureal et al. | 102/202.14 |
| 5,205,757 | 4/1993 | Hertelendy | 439/441 |
| 5,216,325 | 6/1993 | Patel et al. | 313/595 |
| 5,230,287 | 7/1993 | Arrell, Jr. et al. | 102/202.5 |
| 5,249,095 | 9/1993 | Hunter | 361/251 |

(List continued on next page.)

FOREIGN PATENT DOCUMENTS

| | | | |
|---|---|---|---|
| 2213322 | 8/1989 | United Kingdom | 102/202.5 |

*Primary Examiner*—Charles T. Jordan
*Assistant Examiner*—Christopher K. Montgomery

[57] ABSTRACT

A slapper detonator includes an explosive pellet disposed within a detonator housing and a bridge chip disposed within a pocket defined between a pair of printed circuit boards. One of the printed circuit boards is disposed between the bridge chip and the explosive pellet and includes an opening centered over the bridge element to permit a flyer to accelerate before impacting the explosive pellet. The printed circuit board with the opening also establishes a connection between the bridge contact pads and metalized patterns or pads on the other printed circuit board which are, in turn, connected with metalized patterns or pads on an opposite side of the board. Various input contacts can be attached to the metalized pads, including an adapter board which converts side-by-side pads to concentric pads to permit coaxial connectors to be used. The slapper detonator can be used with a hermetic feed-through assembly having a feed-through housing which connects to a fuze housing in hermetically sealed relation and output contacts which mate in a detachable manner with the input contacts on the slapper detonator to permit removal of the detonator from the fuze electronics for periodic inspection and testing.

18 Claims, 10 Drawing Sheets

U.S. PATENT DOCUMENTS

| | | | |
|---|---|---|---|
| 5,275,106 | 1/1994 | Cutting et al. | 102/202.7 |
| 5,285,727 | 2/1994 | Reams, Jr. et al. | 102/202.5 |
| 5,291,828 | 3/1994 | Nerheim et al. | 102/202 |
| 5,337,674 | 8/1994 | Harris et al. | 102/530 |
| 5,347,929 | 9/1994 | Lerche et al. | 102/202.14 |
| 5,370,053 | 12/1994 | Williams et al. | 102/202.5 |
| 5,370,054 | 12/1994 | Reams et al. | 102/202.5 |
| 5,385,097 | 1/1995 | Hruska et al. | 102/202.5 |
| 5,431,101 | 7/1995 | Arrell, Jr. et al. | 102/202.5 |
| 5,431,104 | 7/1995 | Barker | 102/312 |
| 5,479,860 | 1/1996 | Ellis | 102/313 |
| 5,505,134 | 4/1996 | Brooks et al. | 102/202.7 |
| 5,673,478 | 10/1997 | Beene et al. | 29/830 |
| 5,729,897 | 3/1998 | Schmidt et al. | 29/852 |
| 5,731,538 | 3/1998 | O'Brien et al. | 102/202.5 |
| 5,743,004 | 4/1998 | Chobot et al. | 29/830 |
| 5,819,401 | 10/1998 | Johannes et al. | 29/830 |

LOW IMPEDENCE SLAPPER DETONATOR AND FEED-THROUGH ASSEMBLY

CROSS REFERENCE TO RELATED APPLICATIONS

This application claims the benefit of U.S. Provisional Application Ser. No. 60/033,349, filed Nov. 29, 1996, the disclosure of which is incorporated herein by reference.

This invention was made with Government support under F08630-95-C-0049 awarded by the Department of the Air Force. The Government has certain rights in this invention.

BACKGROUND OF THE INVENTION

1. Field of the Invention

The present invention relates generally to electrical initiation systems for explosive devices and, more particularly, to low impedance slapper detonators and feed-through assemblies for use in initiation systems of explosive devices such as, for example, advanced warheads.

2. Discussion of the Related Art

The explosive charge in a slapper detonator is initiated by a flyer plate which is driven to a very high speed over a short distance by the hot gaseous metal and plasma generated by passing a very high current pulse through an exploding foil initiator (EFI) having a thin foil or film bridge. The term "exploding" is used because of the required speed of transformation of the bridge from solid metal to super heated metal vapor and plasma. If the bridge is heated too slowly, it can melt and perhaps electrically open as does a common electrical fuse. Heating the bridge too slowly can also melt, blister, or otherwise damage the material used as the flyer plate. In order to successfully initiate an EFI, it is important to heat the bridge to its melting point before the flyer plate has been disturbed. If the bridge is heated quickly enough, the power in the high current firing pulse flowing through the plasma from the bridge material (which is typically measured in megawatts) goes directly into accelerating the flyer plate material away from the bridge area at an extremely high rate. In other words, the current through the bridge must be as high as possible by the time the total energy dissipated in the bridge is high enough to cause it to burst.

A very rapid rate-of-rise of the current pulse into the initiator, e.g., on the order of tens of thousands of amperes per microsecond, is desirable in order to achieve suitable acceleration of the flyer plate; however, the rate-of-rise of the current pulse is limited by the inductance of the initiating system. Inductance is the physical property of electrical circuits which acts to directly oppose changes in current flow. The voltage drop across an inductor is simply its inductance times the time rate of change of current ($L\,di/dt$). For a hypothetical initial firing voltage of 1,400 volts, a 20 thousand V/$\mu$s rise requires an inductance of no more than 70 nanohenries (nH).

The simple formula set forth above can only predict the initial slope of the current pulse. The effective average rise until the bridge bursts is usually somewhat lower. The formula can, however, be used to accurately estimate the actual inductance of an initiator system from the initial slope of a firing current trace. For a typical EFI and firing circuit, a total system inductance of 20 nH or less is a more reasonable design target.

EFI's for slapper detonators have often been formed by etching a foil bridge on flexible printed circuit boards made of polyimide and placing a hollow, cylindrical member or barrel on a side of the printed circuit board opposite the bridge to create a gap across which the polyimide material can accelerate before impacting an initiating explosive on the other side of the barrel. A number of different approaches have been developed to connect such EFI's to fuze electronics and other sources of current. One approach involves laying the EFI across a pair of layered striplines which are longitudinally offset from one another such that one end of the bridge contacts a copper strip on the bottom stripline while the other end of the bridge contacts a copper strip on the top stripline. The striplines are then clamped or soldered to the fuze electronics to complete the connection. Another approach involves folding the flexible printed circuit board such that the bridge is disposed on an inner surface thereof and providing terminal ends of the boards with holes surrounded by concentric contact rings in the form of a bulls eye so that the printed circuit board can be electrically coupled with the fuze electronics using a bolt inserted through the holes. Yet another approach using flexible printed circuit board technology involves use of a contact board having a coaxial connector thereon with inner and outer contacts configured to mate with the fuze electronics and a transition board disposed between the EFI and the contact board to connect opposite ends of the bridge with inner and outer contacts of the coaxial connector via plated through-holes formed in the boards.

A disadvantage of these approaches is that they are difficult to incorporate into a hermetic package without incorporating the EFI and fuze electronics in a single sealed package which would preclude periodic testing of the fuze electronics by preventing disassembly. An approach achieving hermeticity has been developed utilizing a folded flexible printed circuit board with a bulls eye connector disposed between a barrel and a glass-to-metal sealed feed-through. The feed-through includes pins embedded within glass and contacting portions of the EFI; however, in order to match thermal coefficients of the glass and the metal contacts, it is necessary to use exotic metals such as Kovar which are not highly conductive and, therefore, can increase the inductance of the system. A disadvantage of detonators utilizing flexible printed circuit boards in general is that the thicknesses of the polyimide material and copper cladding are fixed thereby limiting the bridge and flyer plate design to commercially available thicknesses which may not be optimal.

Exploding foil initiators have also been formed using silicon chip technology by depositing a layer of metal on a silicon or ceramic substrate to define a bridge and covering the bridge with an oxide layer which functions as a flyer plate. These so-called bridge chips are advantageous in that the thickness of the bridge and flyer plate materials can be tailored for the particular application; however, connecting firing electronics to such chips can be difficult. One approach involves mounting the chip on a carrier with plural J-shaped leads configured to mate with the firing electronics and connecting the bridge contact pads with the leads using fine wires. While this approach is widely used in commercial applications, there are certain disadvantages when using this technique to build a slapper detonator.

Firstly, the use of fine wires tends to increase the inductance and resistance of the initiating system thereby increasing overall energy requirements. Inductance can be lowered to suitable levels by using a large number of wires, however, connecting a large number of fine wires in this manner is a delicate procedure requiring complex and costly equipment. The presence of a large number of wires also makes it difficult to position a barrel immediately adjacent the bridge. Another approach involves drilling holes through the chip, plating the holes and using the plated through-holes to connect to a stripline or printed circuit board of the firing electronics. While this approach reduces inductance and permits placement of a barrel directly over the bridge, it is difficult and costly to form through-holes in a silicon or ceramic substrate. Still another approach involves separating the copper strip from a stripline of the firing electronics and bending the copper strips so that they overlap the contact pads on the chip. Some of the disadvantages of this type of approach are that it is difficult to assemble and can result in higher inductance due to bending of the copper strip. An additional disadvantage of the aforementioned exploding foil initiators with bridge chips is that the exploding foil initiators are soldered to the firing electronics and thus are not easily removable therefrom to permit periodic testing of the firing electronics.

SUMMARY OF THE INVENTION

Accordingly, it is a primary object of the present invention to overcome the above-mentioned disadvantages of the prior art and to improve slapper detonators and the connectors used to couple slapper detonators with firing electronics.

It is another object of the present invention to provide a low inductance connection between a bridge chip in a slapper detonator and firing electronics in a cost effective and rugged manner.

Still another object of the present invention is to provide a slapper detonator with a universal header assembly for attaching various types of connectors to a bridge chip.

Yet another object of the present invention is to reduce the number of components in a slapper detonator by mounting a bridge chip between layered printed circuit boards and using one of the boards to define a barrel allowing the flyer plate material of the bridge chip to accelerate before impacting the initiating explosive.

The present invention has another object in facilitating periodic testing of the firing electronics in an explosive device by providing a slapper detonator including a bridge chip connected to electrical contacts configured to mate with the firing electronics in a detachable manner.

Some of the advantages of the present invention over the prior art are that commercially available and custom bridge chips can be connected with firing electronics using standard printed circuit boards and simple reflow soldering techniques, that the number of components required to produce a slapper detonator can be reduced, that reliability and performance of a slapper detonator are improved, that assembly and disassembly of the slapper detonator with the firing electronics and output explosive is simplified, and that the slapper detonator can be configured to connect with any type of firing electronics, for example, by use of hermetic feed-throughs attached to the firing electronics housing.

A first aspect of the present invention is generally characterized in a slapper detonator including an explosive pellet disposed within a detonator housing and a bridge chip disposed within a pocket defined between a pair of printed circuit boards. One of the printed circuit boards is disposed between the bridge chip and the explosive pellet and includes an opening centered over the bridge to permit a flyer to accelerate before impacting the explosive pellet. The printed circuit board with the opening also establishes a connection between the bridge contact pads and metalized patterns or pads on the other printed circuit board which are, in turn, connected with metalized patterns or pads on an opposite side of the board. Various input contacts can be attached to the metalized pads, including an adapter board which converts side-by-side pads to concentric pads to permit coaxial connectors to be used. The slapper detonator can be used with a hermetic feed-through assembly having a feed-through housing which connects to a fuze housing in hermetically sealed relation and output contacts which mate in a detachable manner with the input contacts on the slapper detonator to permit removal of the detonator from the fuze electronics for periodic inspection and testing.

Another aspect of the present invention is generally characterized in a method of manufacturing a slapper detonator including the steps of defining a pair of metalized pads on one side of a first printed circuit board, defining a pair of metalized pads on each side of a second printed circuit board, connecting each of the metalized pads on the second printed circuit board with a metalized pad on the opposite side of the second board, defining a pocket between the first and second printed circuit boards, placing a bridge chip with contact pads connected by a bridge in the pocket, positioning each of the metalized pads on the first printed circuit board over a bridge contact pad and a metalized pad on an opposed surface of the second printed circuit board to establish a connection between the bridge contact pad and a metalized pad on an opposite side of the second printed circuit board, and reflowing the solder between the metalized pads. In one embodiment, the pocket is defined in the second printed circuit board. In another embodiment, the pocket is defined by positioning a third printed circuit board with an opening therethrough between the first and second printed circuit boards. Preferably, a small opening is defined through the first printed circuit board above the bridge to permit a flyer positioned over the bridge to accelerate before impacting an explosive pellet, thereby obviating the need for a separate barrel washer.

Other objects and advantages of the present invention will become apparent from the following description of the preferred embodiments taken in conjunction with the accompanying drawings, wherein like parts of each of the several figures are identified by the same reference numerals.

DESCRIPTION OF THE PREFERRED EMBODIMENTS

Figure 1:
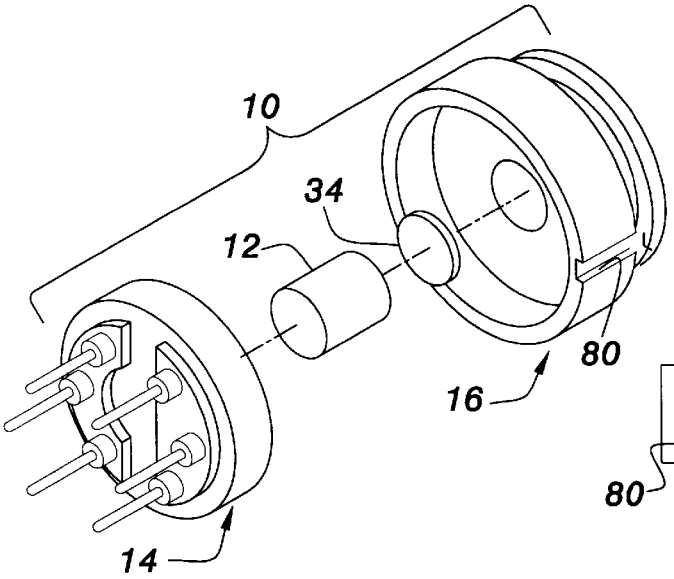
FIG. 1 is an exploded perspective view of a slapper detonator according to the present invention.
Figure 2:
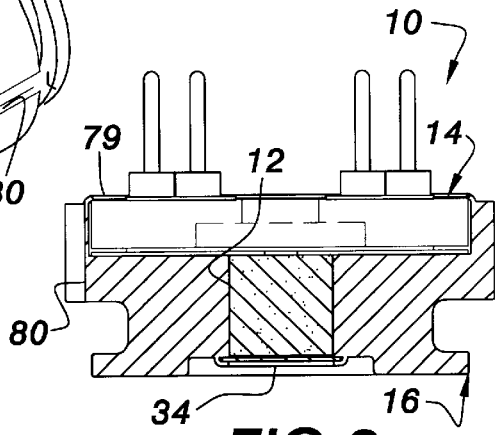
FIG. 2 is a side view, partly in section, of the slapper detonator shown in FIG. 1.
Figure 3:
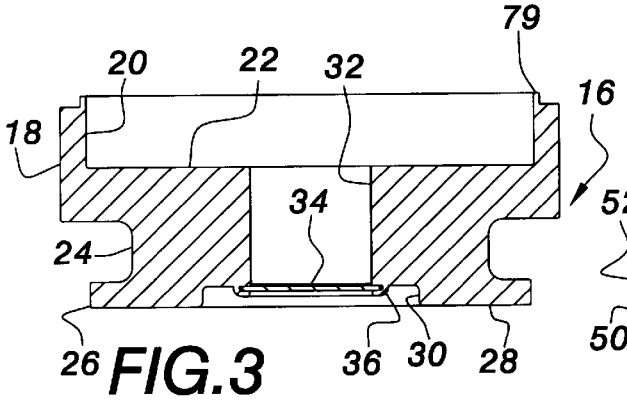
FIG. 3 is a side view, partly in section, of a detonator housing for the slapper detonator according to the present invention.
Figure 5:
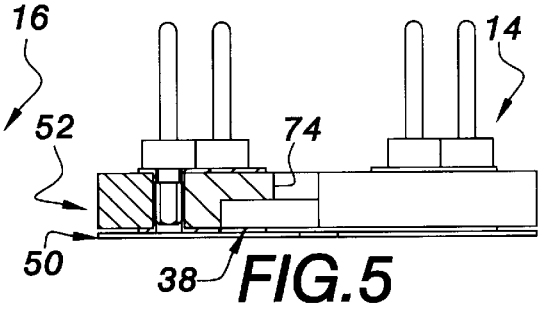
FIG. 5 is a side view, partly in section, of a header assembly for the slapper detonator according to the present invention.
Figure 4:
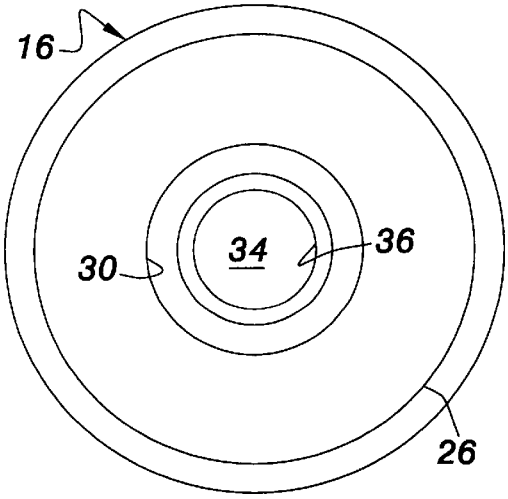
FIG. 4 is a bottom view of the detonator housing shown in FIG. 3.
Figure 6:
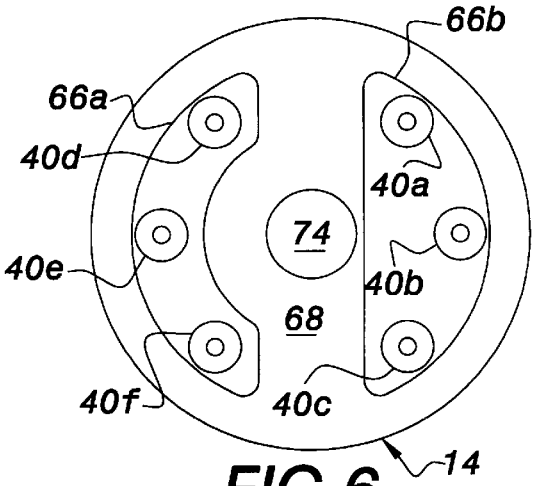
FIG. 6 is a bottom view of the header assembly shown in FIG. 5.

A slapper detonator 10 according to the present invention, as illustrated in FIGS. 1 and 2, includes an explosive pellet 12 and an exploding foil initiator (EFI) or header assembly 14 disposed within a detonator housing 16. Housing 16 includes an upper portion 18 of hollow, cylindrical configuration defining a cylindrical recess 20 which extends downwardly from an open top to a radial step or shoulder 22 connecting the upper portion with a lower portion 24 of the housing of generally cylindrical configuration and smaller diameter than the upper portion, the lower housing portion extending downwardly from the step or shoulder to an outwardly extending flange 26 of circular configuration defining a bottom surface 28 of the housing. A shallow, cylindrical recess 30 is formed in the bottom surface coaxial with a cylindrical bore or chamber 32 of smaller diameter extending downwardly from the recess defined by the upper portion of the housing. A thin, round disk 34 is placed in recess 30 under chamber 32 and is held in place by crimping an annular lip 36 extending downwardly from the recess around the disk. The housing and disk can be formed of any suitable materials including, but not limited to, steel and aluminum. In a preferred embodiment, the housing is formed of Type 303 corrosion resistant steel per ASTM A582, and the disk is formed of Type 303 or 304 corrosion resistant steel.

Explosive pellet 12 is shown as being of circular cylindrical configuration with a diameter to fit telescopically within chamber and a length to extend from the disk to a position substantially flush (e.g., within 0.0004 inch) with the top of the chamber. An adhesive, such as Eastman 910 cyanoacrylate adhesive, is preferably applied to the center of the closing disk 34 before inserting the pellet. The pellet can be formed of any suitable initiating explosive but is preferably formed of fine-particle HNS (surface area of about 10 sq-m/gm) with or without the addition of a few percent (e.g., 2%) Kel-F plastic binder. If desired, a second pellet (not shown) formed of a more powerful explosive, such as PBXN-5, can be placed in the explosive chamber of the housing to boost the output of the first pellet.

Header assembly 14 includes a bridge chip 38 and input contacts 40*a–f* connected by a header 42 to form an integral unit which can be inserted into the recess 20 defined by the upper portion of detonator housing 16. Bridge chip 38 can be of conventional or custom design and includes a substrate 44 having a bottom surface, face or side with metalized portions defining a pair of contact pads 46*a* and *b*connected by a bridge element 48. The substrate can be made of any suitable material including, but not limited to, insulators such as ceramics, glass, polyimide or silicon, but is preferably made of an insulator which is also refractory such as alumina ceramic. Metalized portions of the bridge chip preferably include a base layer of copper or nickel covered by gold in the area of the pads and a flyer material 49 such as polyimide in the area of the bridge element. If desired, a seed coat of TiW can be applied between the substrate and the base layer. An example of a suitable bridge chip for use with the slapper detonator according to the present invention is functionally equivalent to the model NAWCO2 bridge chip available from Silicon Designs, Inc., of Issaquah, Wash., but with a ceramic substrate of rectangular configuration having a length of about 0.20 inch, a width of about 0.16 inch and a thickness of about 0.03 inch, gold plated nickel or copper base metalization and a polyamide flyer. Other materials, such parylene, can also be used for the flyer. The flyer material can be deposited in a pattern on the bridge chip either prior to its assembly in the header or, in the case of materials such as parylene, the flyer can be deposited through the barrel after the header is fully assembled.

Figure 8:
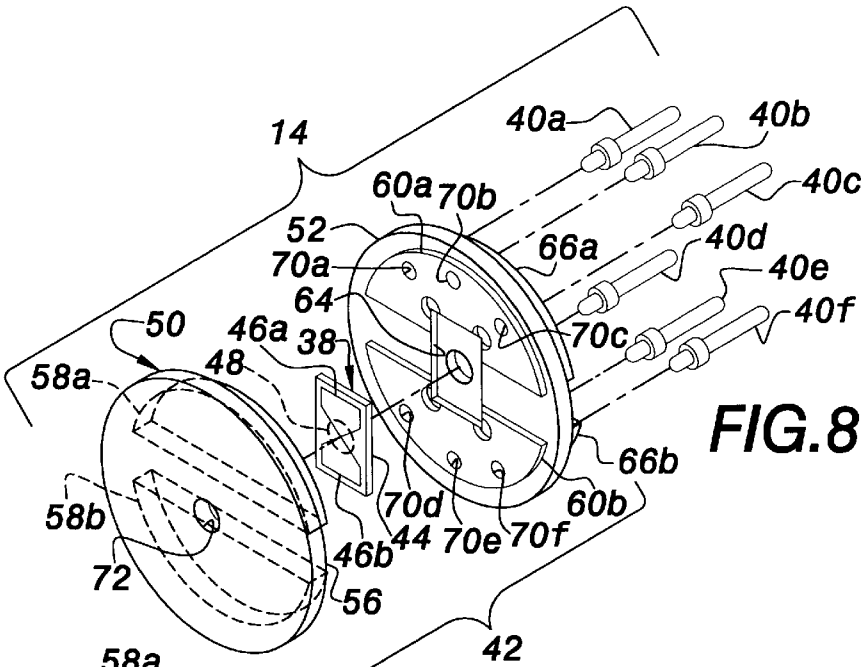
FIG. 8 is an exploded perspective view of the header assembly shown in FIG. 5.
Figure 7:
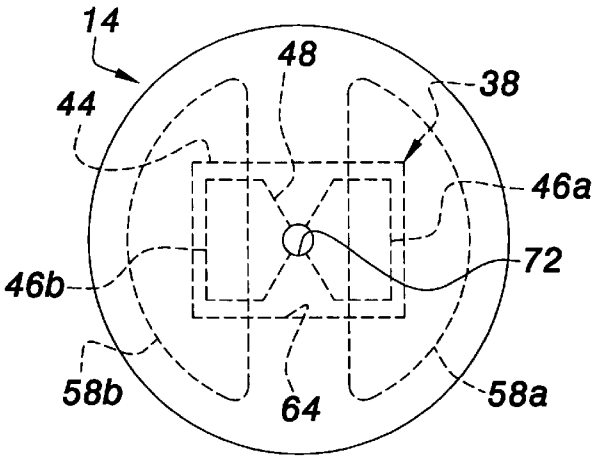
FIG. 7 is a top view of the header assembly shown in FIG. 5.
Figure 9:
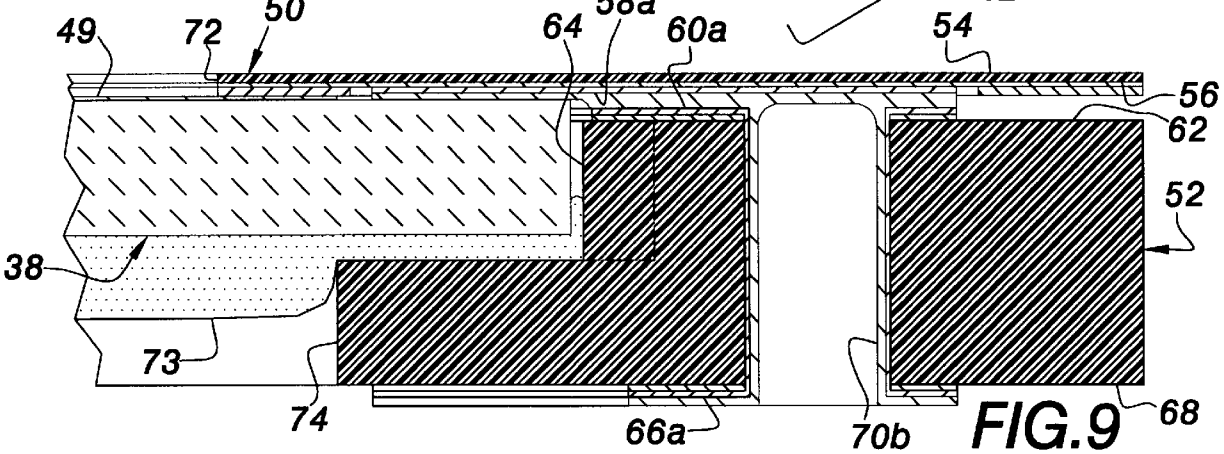
FIG. 9 is an enlarged fragmentary view of the header assembly for the slapper detonator shown in FIG. 1.

As best seen in FIGS. 8 and 9, header 42 includes a first printed circuit board 50 disposed beneath the bridge chip and a second printed circuit board 52 disposed above the bridge chip, the printed circuit boards being of circular configuration to fit within the recess 20 in the upper portion of the detonator housing. The first printed circuit board 50 includes a bottom surface, face or side 54 which rests on the shoulder 22 at the bottom of recess 20 and a top surface, face or side 56 with a pair of metalized patterns or pads 58*a* and *b* which face upwardly to provide an electrical path or bridge between respective contact pads 46*a* and *b* of the bridge chip and a pair of metalized patterns or pads 60*a* and *b* on the bottom surface, face or side 62 of the second printed circuit board. The metal pads 58*a* and *b* on the top surface of the first printed circuit board 50 resemble halves of a circle separated by a gap. Metal pads 60*a* and *b* on the bottom surface of second printed circuit board 52 are similar to and aligned with metal pads 58*a* and *b* on the top surface of first printed circuit board 50 but with a pocket 64 formed therebetween to hold bridge chip 38. Pocket 64 is shown extending part way into each metal pad on the bottom surface of second printed circuit board 52 so that, when bridge chip 38 is disposed within the pocket, pads 58*a* and *b* on the first printed circuit board will overlap pads 46*a* and *b* on the bridge chip as well as pads 60*a* and *b* on the bottom surface of the second printed circuit board to provide an electrical bridge therebetween. The size of the pocket is dependent upon the size of the bridge chip. Preferably, the depth of the pocket is such that, when the chip is disposed within the pocket, the metalized surface of the chip will be substantially flush with the bottom surface of the second printed circuit board.

Contact pads 60*a* and *b* on the bottom surface of the second printed circuit board are electrically connected to a pair of metalized patterns or pads 66*a* and *b* on the top surface, face or side 68 of the board by a plurality of plated through-holes 70*a–f* extending through the board. Pad 66*a* on the top surface of the second board is of arcuate configuration while pad 66*b* is similar in shape and size to the corresponding pad (i.e., element 60*b*) on the bottom surface of the board. Three plated through-holes are shown extending through each pad in arcuately spaced relation, however, as few as one or more than three plated though-holes can be used for each side of the circuit.

A small opening or aperture 72 is formed through the substrate of the first printed circuit board 50 in alignment with bridge element 48 of the bridge chip to define a gap across which the flyer can accelerate before impacting the explosive pellet. If the board thickness is chosen to optimize the size of the gap, the first printed circuit board will perform the functions of a barrel in addition to its function as an electrical bridge thereby obviating the need for a separate barrel.

The header 42 is assembled by adhesively bonding the bridge chip 38 in the pocket 64 formed in the second printed circuit board 52 using a standard die-bond adhesive 73. One or more holes 74 may be formed through the center of the second printed circuit board in communication with pocket 64 to give access to the back or top of the bridge chip to facilitate flush positioning of the chip against the first printed circuit board 50 as the die-bond adhesive cures. Clearance tolerances between the back or top of the bridge chip and the second header board 52 are accommodated by varying the thickness of the adhesive layer. The printed circuit boards making up the header and the bridge chip are physically and electrically connected using one of three possible techniques. The first is to use solder-coated boards or screen printed solder paste, and to reflow the solder by resistance or induction heating under slight pressure during final assembly. A second technique is to use conductive epoxy bonding. The third technique is to bond the boards with a z-axis adhesive such as Z-Link Adhesive, P/N-3-T190555 from the Sheldahl Corporation of Northfield, Minn. Prior to, during or after the printed circuit boards are physically and electrically connected, input contacts 40*a–f* can be attached to pads 66*a* and *b* on the top surface of the second printed circuit board.

Six input contacts 40*a–f* in the form of contact pins are shown connected to the pads on the top surface of the second printed circuit board. Three pins 40*a–c* are soldered to pad 66*a* on one side of the circuit, and three pins 40*d–f* are soldered to pad 66*b* on the other side of the circuit. Any suitable contact pins can be used so long as they can carry large currents (e.g., on the order of 3000 amps) for short periods of time (e.g., less than 1 microsecond). An example of a suitable contact pin which can be used is the 0.018 inch diameter contact pin, P/N M9000-0-00-01-00-00-03-0, from Mil-Max Manufacturing Corporation of Oyster Bay, N.Y.

Figure 10:
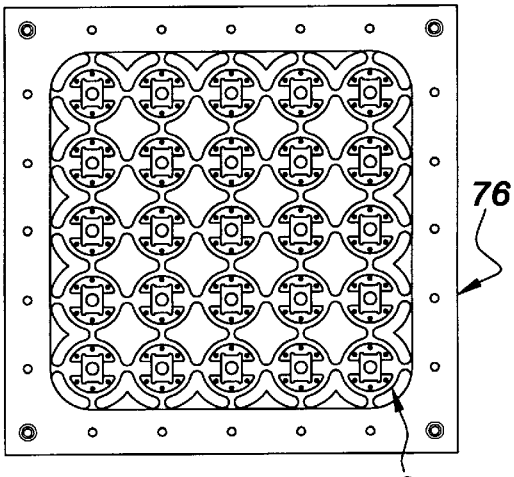
FIG. 10 is a top view of an array of chip carrying header boards for use in fabricating slapper detonators according to the present invention.
Figure 13:
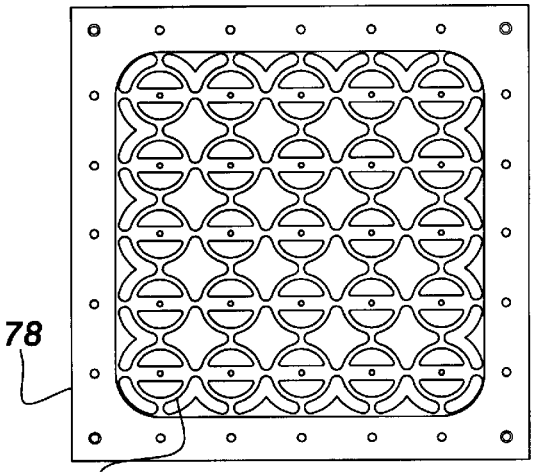
FIG. 13 is a bottom view of an array of barrel header boards for use in fabricating slapper detonators according to the present invention.
Figure 11:
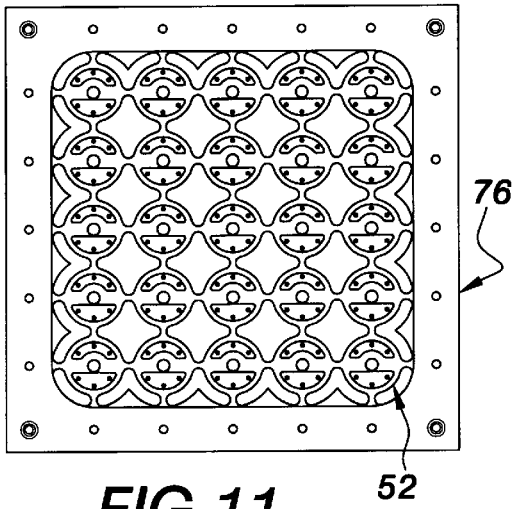
FIG. 11 is a bottom view of the header board array shown in FIG. 10.
Figure 14:
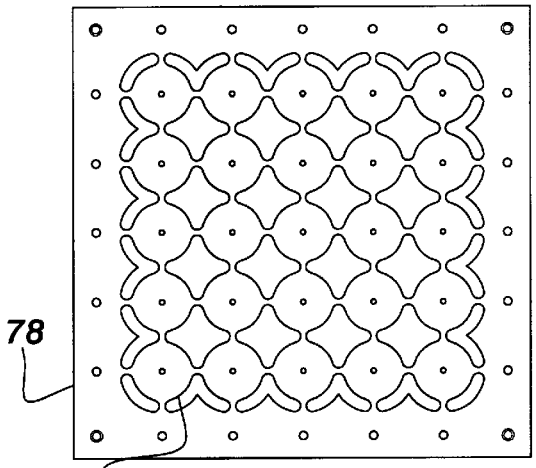
FIG. 14 is a top view of the barrel board array shown in FIG. 13.
Figure 12:
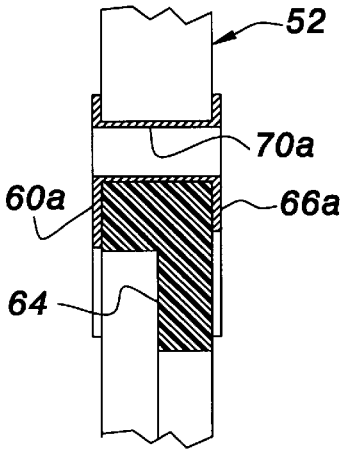
FIG. 12 is a fragmentary side view, partly in section, of the header board array shown in FIGS. 10 and 11.
Figure 15:
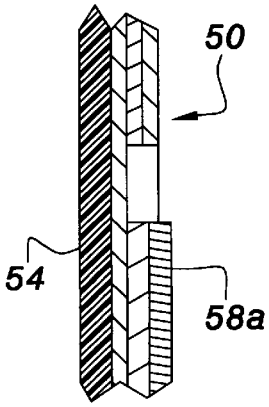
FIG. 15 is an enlarged fragmentary side view, partly in section, of the barrel board array shown in FIGS. 13 and 14.

A simple method of fabricating multiple header assemblies uses arrays of header components formed on individual printed circuit boards. For example, in FIGS. 10–12, a printed circuit board 76 including an array of twenty five chip carrying header components 52 is shown in which the components are connected to one another at predetermined intervals. The metal pads, plated through-holes and bridge chip pockets have been formed on each component while they are in the array. FIGS. 13–15 show another printed circuit board 78 including an array of twenty five barrel defining header components 50 connected to one another at predetermined intervals allowing the barrel components to be precisely located against corresponding chip carrying components merely by placing boards 76 and 78 against one another on a fixture having pins which extend through alignment holes formed along the periphery of the boards. After the bridge chips are bonded in the respective pockets, the bridge chips and contact pads for multiple headers can be physically and electrically connected at the same time. The individual header assemblies can then be punched, routed or diced by sawing from the array board assembly.

To assemble the slapper detonator 10, explosive pellet 12 is positioned within chamber 32 at the top of detonator housing 16 and a header assembly 14 is positioned in recess 20 at the bottom of the detonator housing. The pellet can be pressed in place within the chamber but is preferably a free-standing pre-pressed pellet capable of being inserted directly into the chamber. Metal closure disk 34 can be positioned in recess 30 and crimped in place before or after the pellet is loaded, depending upon the specific design. The closure disk could also be provided by machining the explosive chamber so that it has a very thin bottom wall rather than an opening, or by welding a disk to the detonator housing. As mentioned above, a small amount of adhesive is preferably placed on the upper surface of the closure disk to adhesively bond the pellet against the disk. Header assembly 14 is inserted into recess 20 at the top of the detonator housing and advanced downwardly until the bottom surface 54 of the first printed circuit board 50 of the header abuts the shoulder or step 22 at the bottom of the recess and the top of the explosive pellet. The header assembly is secured to the housing by crimping lip 79 along the inner peripheral edge of the upper portion of the detonator housing inwardly around the periphery of the header assembly. The overall detonator assembly package is about 0.5 inch in diameter and about 0.25 inch long, dependent upon the explosive and other features of the interface associated with the final application. One such feature is to incorporate some type of key on the detonator to insure proper engagement of the contacts. For example, a keyway 80 in the form of a longitudinal slot or groove is shown on an outer surface of the detonator housing for receiving a pin extending inwardly from a feed-through as described below; however, any type of keying mechanism can be used.

Figure 16:
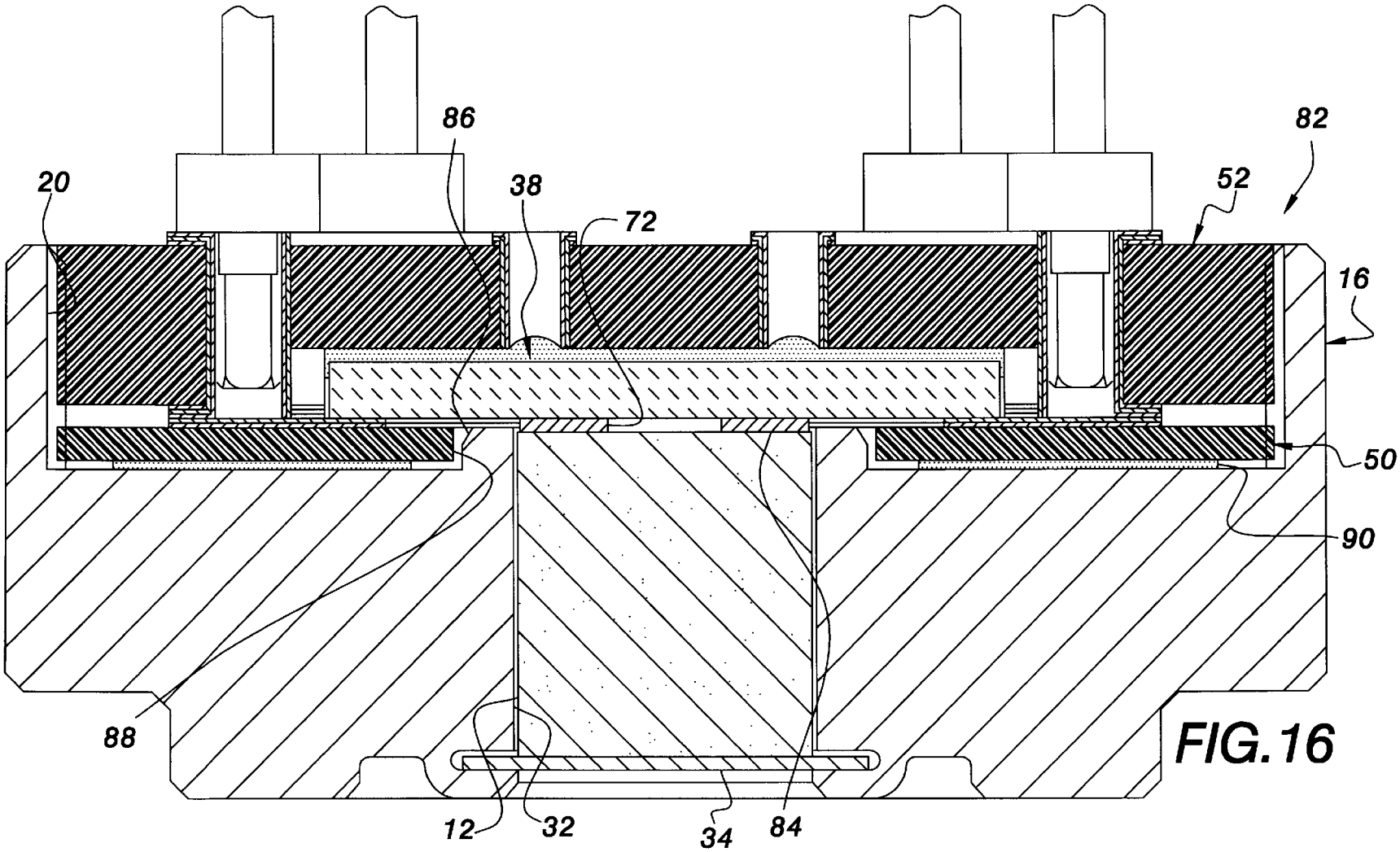
FIG. 16 is an enlarged fragmentary side view, partly in section, of a modification of a slapper detonator according to the present invention.

A modification of a slapper detonator according to the present invention, shown in FIG. 16 at 82, is similar to detonator 10 described above but is modified to include a separate barrel 84 in the event it is not desirable or practical to use the first printed circuit board of the header as a barrel. In the modified detonator 82, the barrel 84 is defined by a flat, thin washer made of an appropriate non-conductive material, such as polyimide, and having an outer diameter similar to that of the explosive pellet 12. The barrel is positioned between bridge chip 38 and the explosive pellet and is laterally restrained by a cylindrical boss 86 extending upwardly from the peripheral edge of the explosive chamber 32 into the header recess 20. The first and second printed circuit boards 50 and 52 are identical to those described above with the exception that the first board is configured with a central opening 88 large enough to fit over the boss. Another difference between the modified slapper detonator shown in FIG. 16 and the detonator described above is that the header assembly is mounted within the detonator housing using an adhesive 90, such as a die-bond adhesive, applied between the first printed circuit board and the bottom of the header recess.

Figure 17:
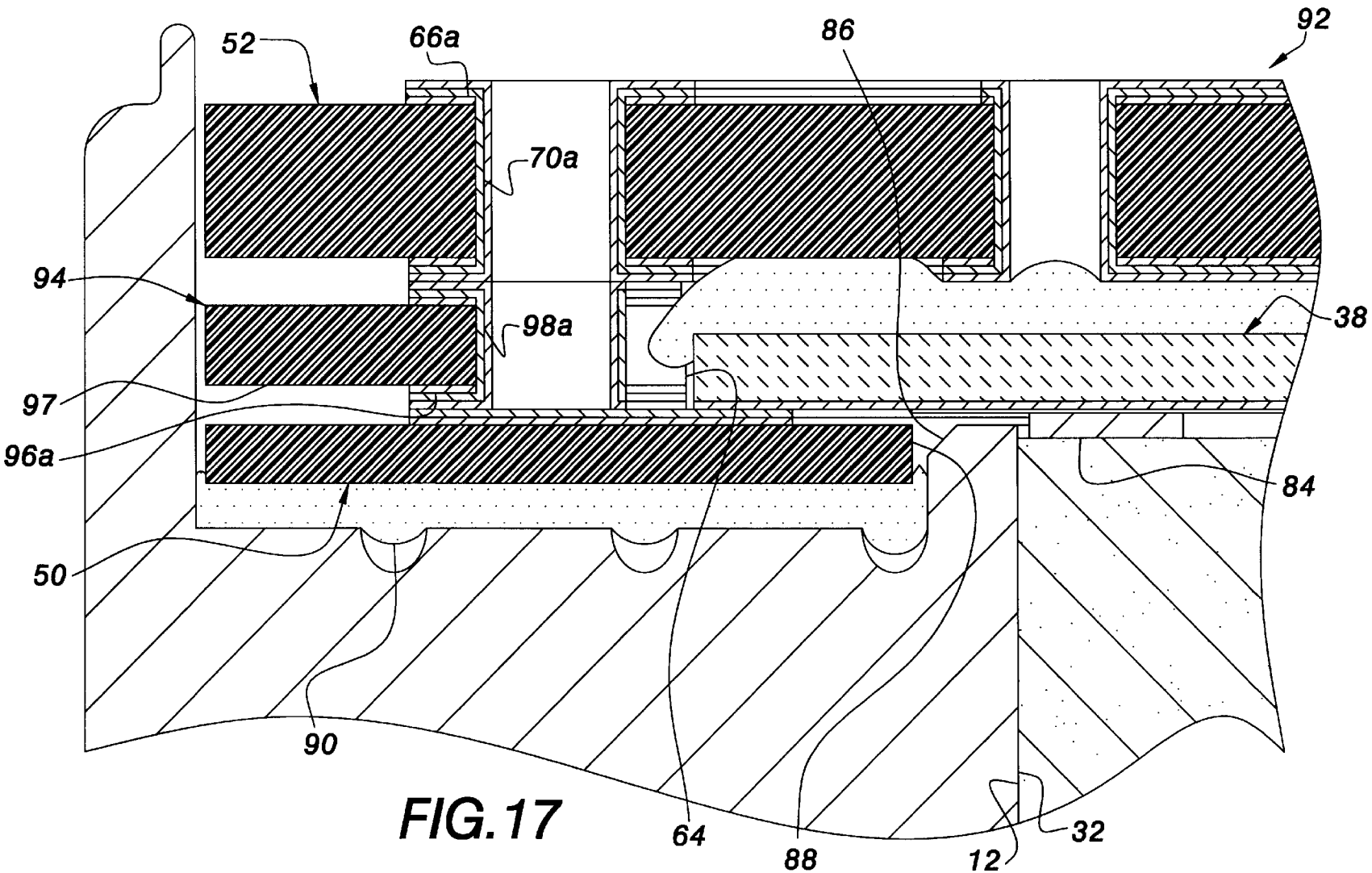
FIG. 17 is an enlarged fragmentary side view, partly in section, of another modification of a slapper detonator according to the present invention.

Another modification of a slapper detonator according to the present invention, shown in FIG. 17 at 92, is similar to the detonator described above in that it utilizes a separate barrel 84 disposed within a boss 86 defined by the detonator housing 16; however, the bridge chip pocket 64 in the header is formed by a third printed circuit board 94 with a central aperture or cut-out positioned between the first and second printed circuit boards 50 and 52. The third printed circuit board 94 also includes pads 96*a* (shown) and 96*b* (not shown) on a bottom surface 97 which are similar to those described above for the second header board and plated through-holes 98*a* (shown) and 96*b–f* (not shown) aligned with the plated through-holes formed in the second board to electrically connect the pads on the bottom surface of the third board with pads 66*a–f* on the top surface of the second board. Bridge chips of various thicknesses can be accommodated by varying the thickness of the third board accordingly.

The slapper detonator according to the present invention can be used to detonate an output explosive, such as a booster charge, by placing the detonator against the charge and applying a voltage across the input contacts over a short period. A current pulse travels through the metalized patterns formed in the header and to the bridge chip causing the bridge to be vaporized, thereby creating a plasma jet which drives the polyimide flyer through the barrel opening and into the explosive pellet. The explosive pellet is caused to ignite thereby driving the closure disk away from the detonator housing and into the output explosive which is also detonated.

The detonator can be attached directly to firing electronics utilizing the input contacts or a separate feed-through assembly can be mounted on the electronics housing to connect the detonator with electronics in the housing while maintaining a hermetic seal. An example of a feed-through assembly 100 for use with a slapper detonator according to the present invention and a fuze housing 102 is illustrated in FIGS. 18–21. Feed-through assembly includes a threaded sleeve 104 configured to fit within an opening 106 formed in the fuze housing, and a feed-through housing 108 including output contacts 110*a–f* configured to fit within the sleeve and mate with the input contacts of the slapper detonator. Sleeve 104 includes an externally threaded upper portion 112 extending downwardly from the top of the sleeve to a radial step or shoulder 114 connecting the threaded upper portion with a hollow, cylindrical lower portion 116 of smaller diameter configured to fit within opening 106 formed in the fuze housing to permit attachment by welding or the like, the radial step or shoulder serving as a stop or abutment contacting portions of the fuze housing around the hole to prevent the sleeve from sliding into the housing. The upper portion of the sleeve defines a cylindrical recess 118 extending downwardly from the top of the sleeve to a radial step or shoulder 120 connecting the recess with a bore 122 of smaller diameter extending through the lower portion of the sleeve.

Feed-through housing 108 includes an upper cylindrical portion 124 defining a recess 126 for receiving the detonator assembly and a lower cylindrical portion 128 mounting an insulator plate 130 with output contacts 110*a–f* in the form of contact sockets extending therethrough, the lower cylindrical portion of the feed-through housing being of smaller diameter than the upper portion to fit telescopically within the recess defined by the upper portion of the sleeve. A keying element 132 in the form of a pin extends inwardly from the upper portion of the feed-through housing to ride within the keyway 80 defined by the slot or groove in the detonator housing when the detonator is properly oriented and to prevent insertion of the detonator when not properly oriented. A radial step or shoulder 134 extends inwardly from a bottom of the recess to serve as a stop or abutment preventing further downward movement of the detonator when it is properly seated within the feed-through housing. Insulator plate 130 is a circular disk formed of an insulating material, such as alumina ceramic, with a metalized peripheral edge 136 and a pair of arcuate metalized patterns or pads 138*a* and *b* on each side of the disk, each arcuate pattern being connected with a corresponding pattern on the opposite side by three plated through-holes receiving output contacts in the form of contact sockets. Contact sockets 110*a–f* are positioned to receive contact pins 40*a–f*, respectively, of the slapper detonator when the detonator is fully seated within the feed-through housing and to protrude into the fuze housing to connect with firing electronics disposed therein. Metalized peripheral edges 136 of the insulating disk are solder sealed to the feed-through housing 108 in order to maintain a hermetic seal.

Figure 18:
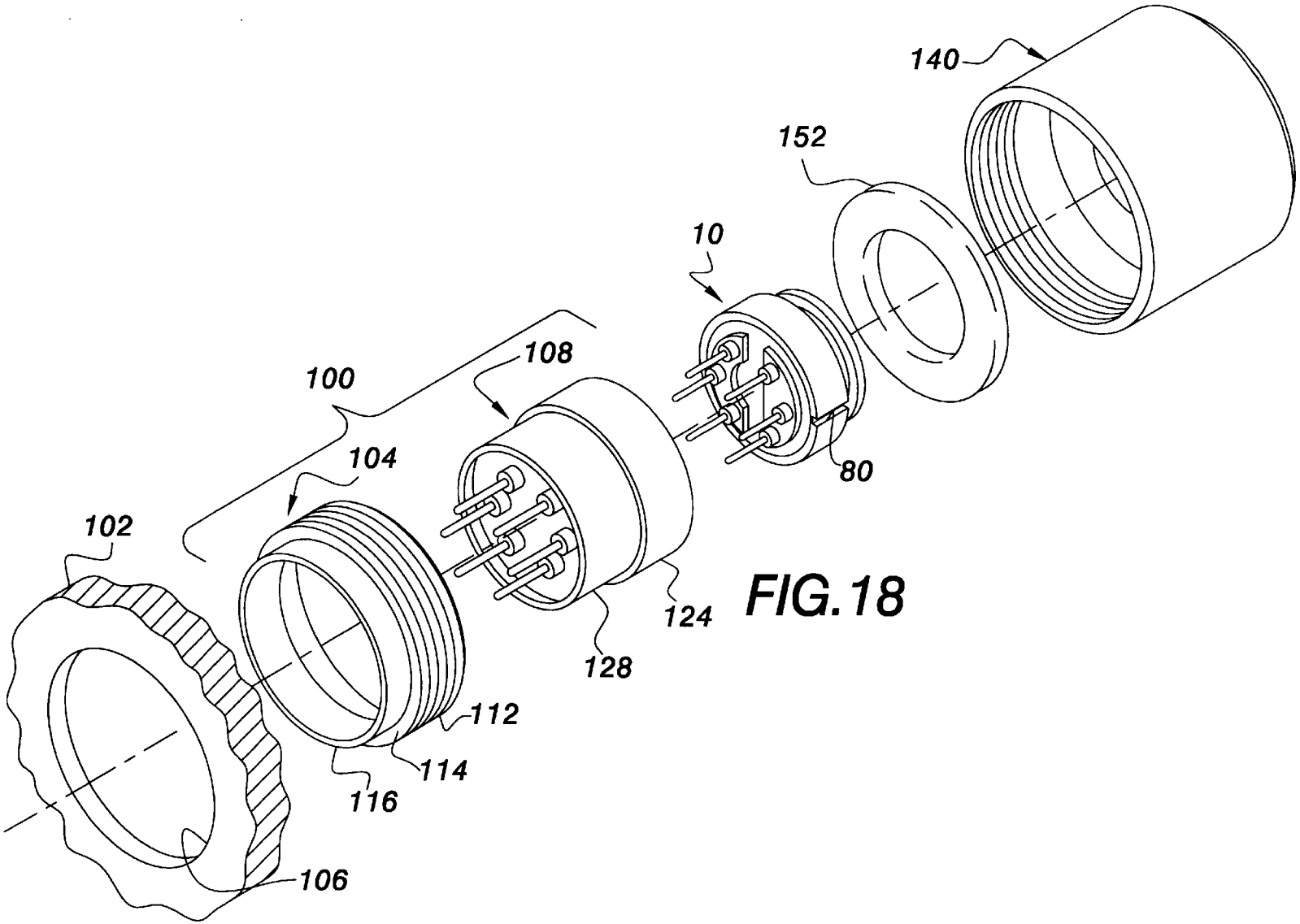
FIG. 18 is an exploded perspective view of a slapper detonator according to the present invention together with an hermetic feed-through assembly and a booster assembly.
Figure 19:
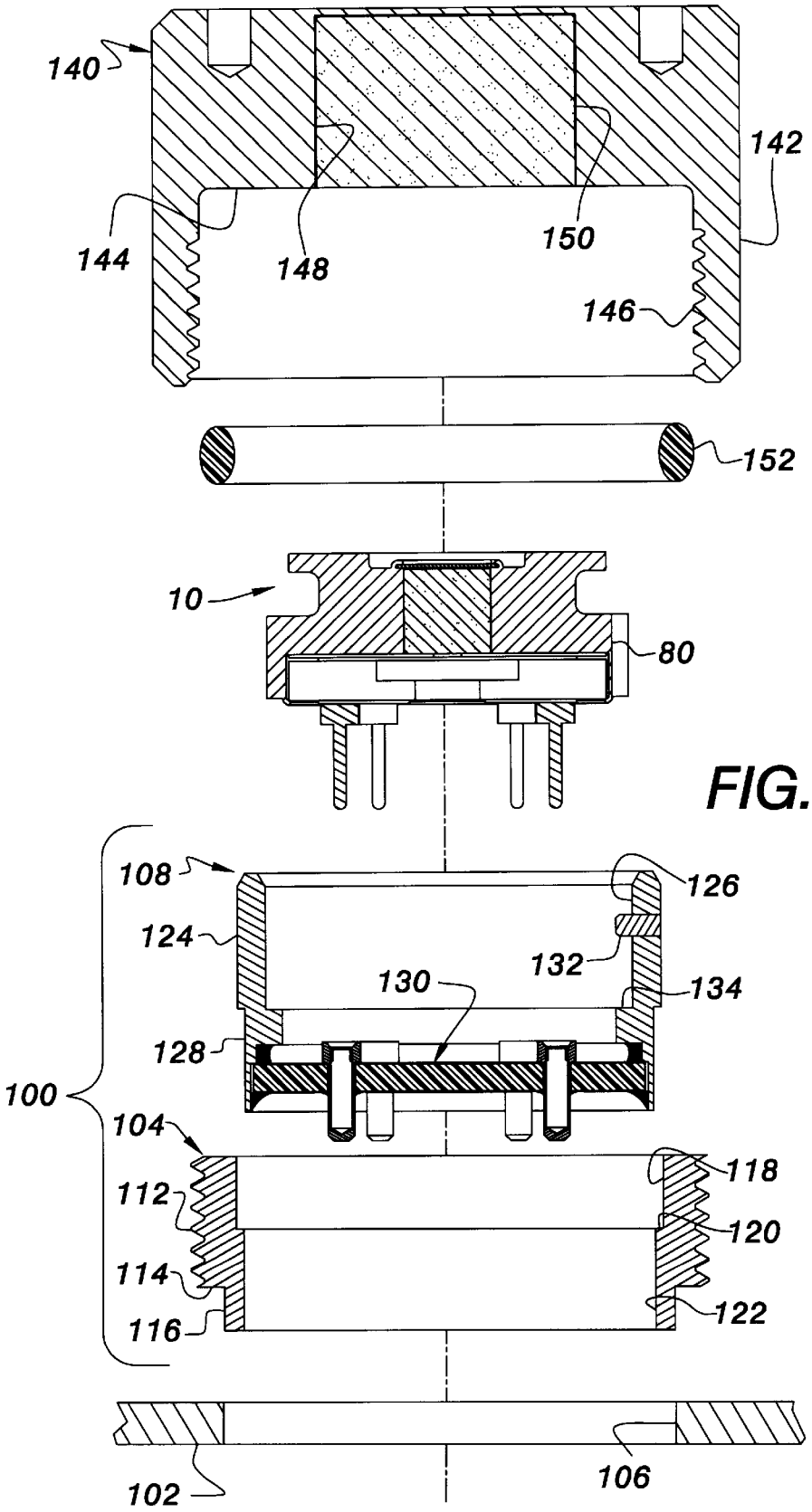
FIG. 19 is an exploded side view of the slapper detonator, feed-through assembly and booster shown in FIG. 18.
Figure 20:
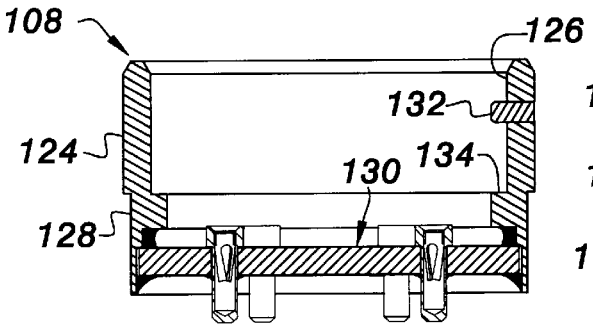
FIG. 20 is a side view, partly in section, of the feed-through assembly shown in FIG. 18.

A secondary explosive assembly 140 in the form of a booster charge is also shown in FIGS. 18 and 19 and includes a booster cup 142 defining a lower recess 144 with internal threads 146 configured to couple with the externally threaded portion 112 of the sleeve and an explosive chamber 148 above the recess holding explosive material 150. When the feed-through housing 108 is inserted into the sleeve 104 and the detonator 10 is inserted into the feed-through housing, the secondary explosive assembly 140 can be fitted over the slapper detonator assembly and screwed down against an O-ring 152 to maintain the hermetic seal. The booster cup 142 may also be used merely as a retainer when no explosive is contained therein.

Sleeve 104 and outer portions of the feed-through housing 108 can be formed of any suitable material but are preferably formed of a metal such as Type 303 steel, 6061 T6 aluminum alloy or half-hard brass alloy 360. Insulator plate 130 can be formed of any insulating material capable of maintaining a hermetic seal but is preferably formed of alumina ceramic with metalized patterns formed of copper. Other materials, such as FR4 epoxy glass can be used for the insulator plates whenever hermeticity is not required by the final application. Contact sockets 110*a–f* can have any suitable configuration to mate with contact pins 40*a–f* but are preferably purchased as a set with the contact pins.

Figure 23:
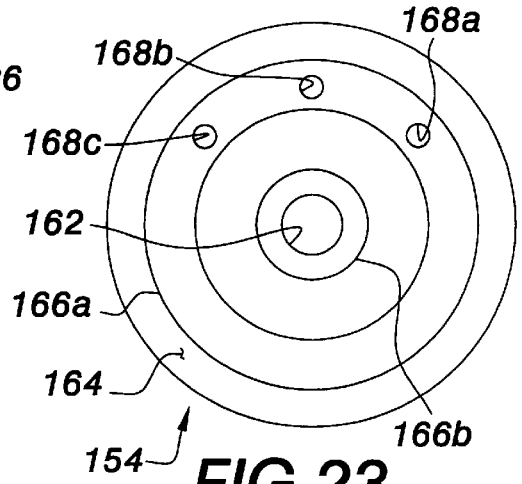
FIG. 23 is a bottom view of the adapter board shown in FIG. 22.
Figure 21:
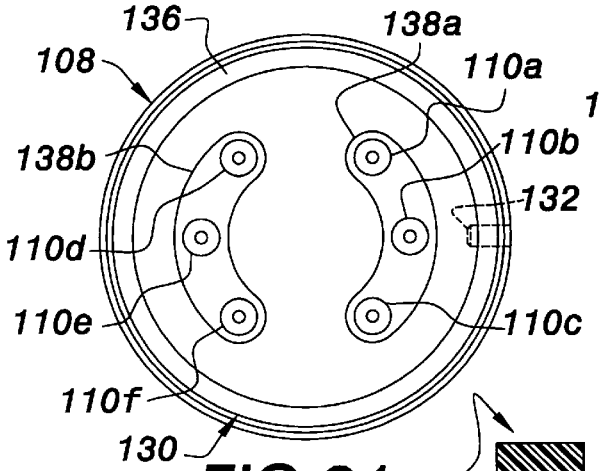
FIG. 21 is a bottom view of the feed-through assembly shown in FIG. 18.
Figure 22:
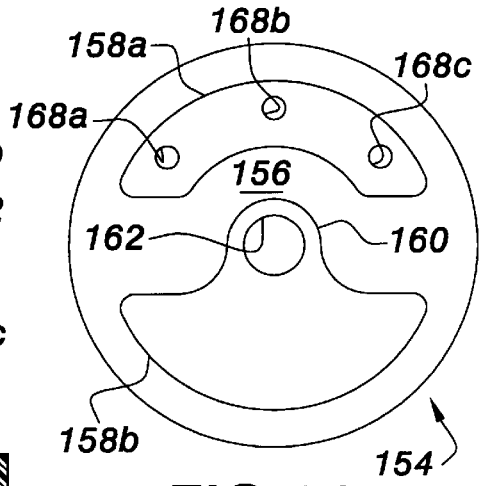
FIG. 22 is a top view of an adapter board for use with the slapper detonator according to the present invention.
Figure 24:
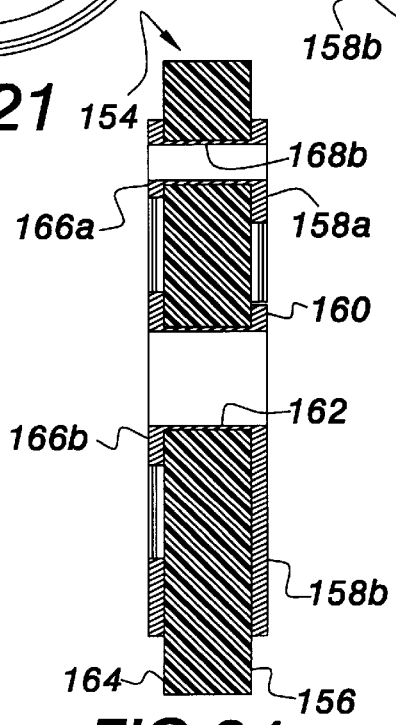
FIG. 24 is a side view, partly in section, of the adaptor board shown in FIGS. 22 and 23.

While the slapper detonator and feed-through assemblies described above have utilized standard contact pins and sockets, it will be appreciated that other types of contact sets can be used. For example, in FIGS. 22 and 23, an adaptor 154 in the form of a printed circuit board is shown which can be incorporated into the bridge header assembly to convert the side-by-side pads on the top surface of the second printed circuit board into concentric ring-shaped pads to which various coaxial connectors can be connected. The adaptor board is a flat, circular disk with a bottom surface, face or side 156, shown in FIG. 22, having an arcuate metalized pattern or pad 158*a* thereon which can be laid against the corresponding pattern 66*a* on the top surface of the second printed circuit board and a generally semicircular metalized pattern 158*b* with an ring-like extension 160 surrounding a plated through-hole 162 in the center of the board, the semicircular metalized pattern being aligned with a similar pattern 66*b* on the top of the second printed circuit board when edges of the boards are aligned. The top surface, face or side 164 of the adapter board includes concentric ring-shaped patterns 166*a* and *b* connected with the patterns on the bottom surface via plated through-holes 162 and 168*a, b* and *c* as shown in FIG. 24.

Figure 25:
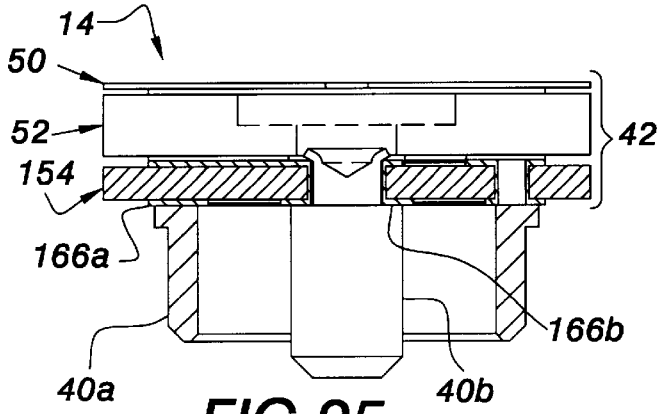
FIG. 25 is a side view, partly in section, of a modified header assembly utilizing the adapter board shown in FIGS. 22–24.
Figure 27:
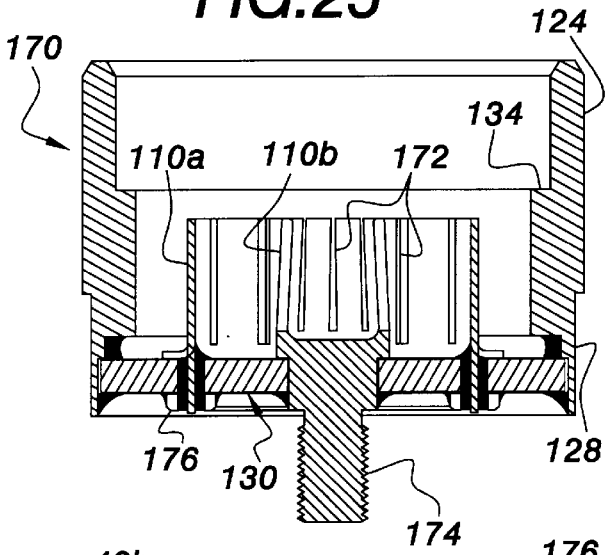
FIG. 27 is a side view, partly in section, of a feed-through assembly for use with the header assembly shown in FIGS. 25 and 26.
Figure 26:
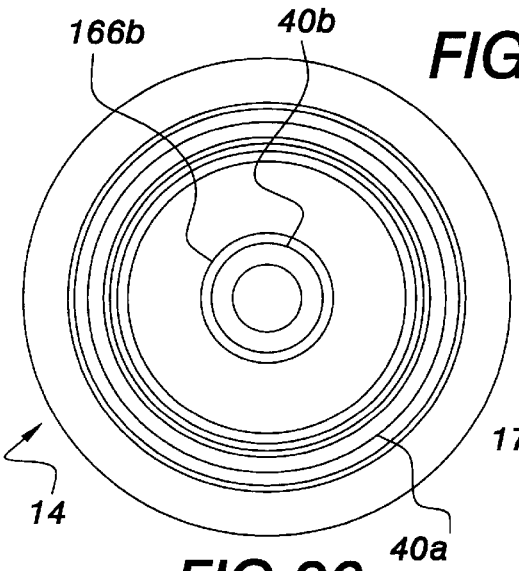
FIG. 26 is a bottom view of the modified header assembly shown in FIG. 25.
Figure 28:
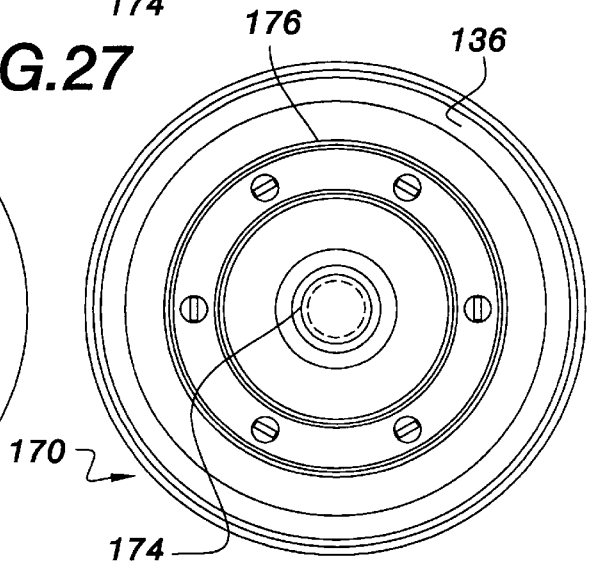
FIG. 28 is a bottom view of the feed-through assembly shown in FIG. 27.

Various types of input contacts can be attached to the concentric ring-shaped patterns 166*a* and *b* on the top surface of the adapter board 154. In FIGS. 25 and 26, for example, axially compliant concentric cylinder style input contacts 40*a* and *b* are shown. More specifically, an inner contact 40*b* in the form of a rigid post or pin is shown protruding downwardly from the center of an outer contact 40*a* in the form of a hollow, rigid cylinder, the inner contact being soldered to the inner pattern 166*b* and the outer contact being soldered to the outer pattern 166*a*. A modified feed-through assembly 170 is shown in FIGS. 27 and 28 for mating with the concentric cylinder style input contacts 40*a* and *b* of the slapper detonator shown in FIGS. 25 and 26. The feed-through assembly 170 includes output contacts 110*a* and *b* in the form of concentric cylinders with longitudinal relief cuts 172 forming flexible fingers. The flexible inner cylinder 110*b* of the feed-through contact is configured to receive the rigid inner cylinder 40*b* of the slapper detonator and the flexible outer cylinder 110*a* of the feed-through contact is configured to receive the rigid outer cylinder 40*a* of the slapper detonator. The flexible concentric cylinder contacts of the feed-through assembly are shown connected to a traditional bulls-eye interface having a threaded post 174 protruding downwardly from the center of a contact ring 176 to interface with a printed circuit board or stripline (not shown). While the more complex fingered contacts are shown on the feed-through assembly and the simpler rigid mating contacts are shown on the slapper detonator, it will be appreciated that these contacts could be exchanged if desired. The concentric cylindrical contacts provide greater axial compliance but are somewhat more difficult to assemble. To avoid excessive stress during mating, these types of contacts should be soldered to within about 0.002 inch true position of one another. Since the outer contact is thermally massive, it is also a good idea to improve heat transfer during soldering using any well-known method.

It is also possible to form a feed-through without a separate housing by using the sleeve as a housing and mounting the insulating plate directly in the sleeve, for example as shown and described in the aforementioned U.S. Provisional Patent Application Ser. No. 60/033,349. While the feed-through assemblies described above utilize a single insulator plate with plated through-holes, it will be appreciated that more than one insulator plate can be used to minimize the need for through-holes, for example as shown and described in the aforementioned U.S. Provisional Patent Application Ser. No. 60/033,349. Any of the feed-through designs shown in the aforementioned Provisional Patent Application Ser. No. 60/033,349 can be used with the slapper detonator described herein.

Figure 29:
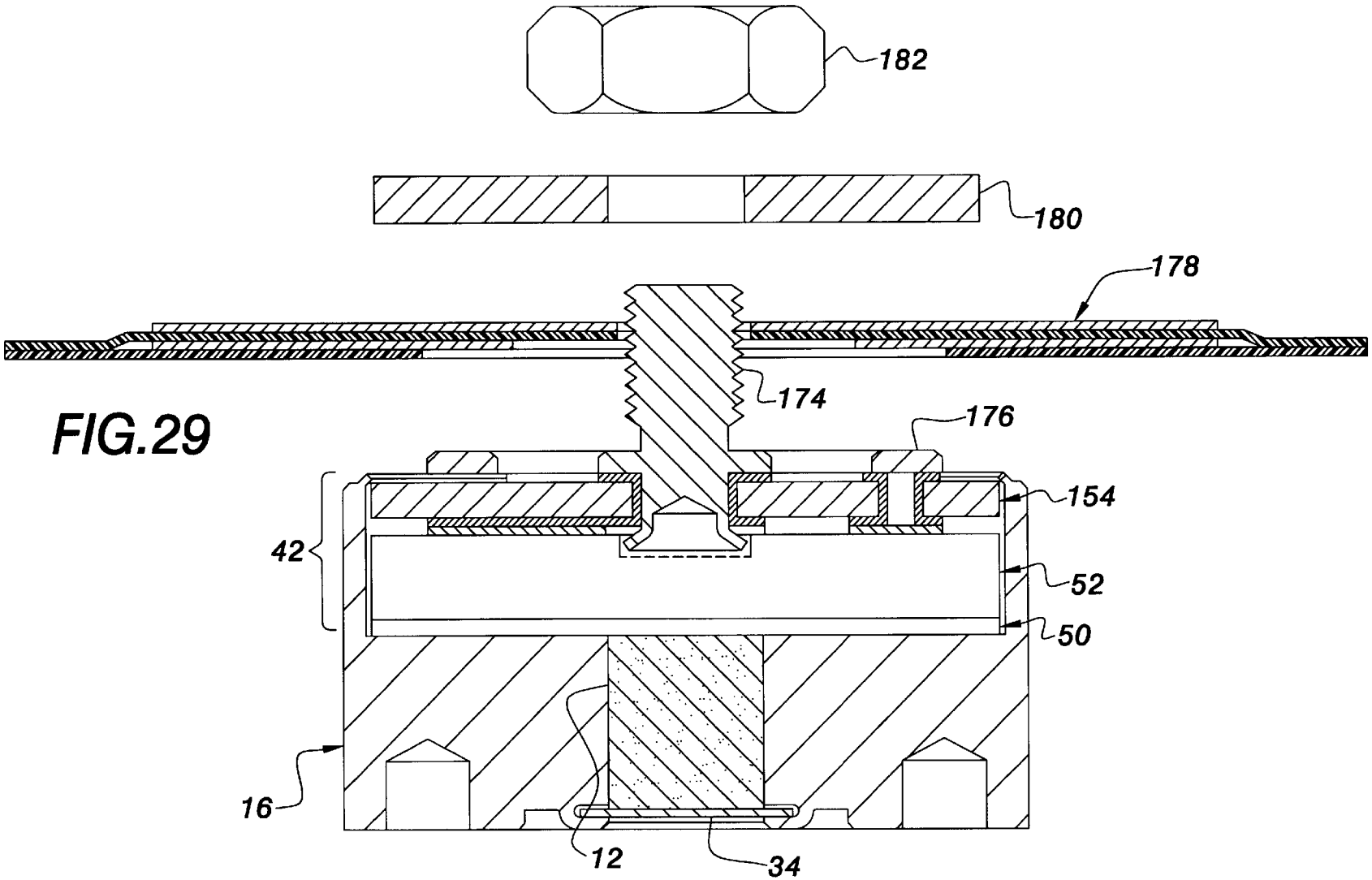
FIG. 29 is a side view, partly in section, of a modification of a slapper detonator according to the present invention.

A traditional bulls-eye interface including a threaded post 174 and a circular contact ring 176 can be soldered directly to the header 42 as shown in FIG. 29 when the adapter board 154 is incorporated into the header and there is no need for hermeticity or axial compliance to account for non-planar variations in the mating surfaces, for example in a multi-point array warhead where the detonator would be attached directly to the array stripline 178 using a metal washer 180 and a nut 182. The header, with or without an adapter board, can also be soldered directly to firing electronics using the side-by-side patterns on the second printed circuit board in applications not requiring that the detonator be removable for periodic testing of the electronics.

While the bridge chip pocket is described above as being formed by a recess in the bottom surface of the second printed circuit board of the header or by a third board with a cut-out disposed between the first and second header boards, it will be appreciated that the pocket could be formed by a recess in the top surface of the first board or by opposed recesses in respective top and bottom surfaces of the first and second boards if desired. The shape and size of the pocket will depend upon the type of bridge chip used. While a generally rectangular pocket is shown for holding a rectangular chip, it will be appreciated that other shapes can be used including circular, elliptical and polygonal shapes as well as any combinations thereof.

The printed circuit boards used in fabricating the header for the slapper detonator can be formed of any standard circuit board material including, but not limited to, FR4 epoxy glass circuit board material and flexible polyimide or Kapton dependent upon the component being fabricated and the application. In general, the boards carrying the bridge chip or converting the contacts are preferably formed of FR4 epoxy glass for rigidity and strength while the board defining the barrel or providing a bridge between the bridge contacts and the other boards is preferably formed of polyimide. As mentioned above, the insulator plates in the feed-through assembly can be formed of various materials including, but not limited to, alumina ceramic and FR4 epoxy glass dependent upon the need for hermeticity in the application. The shape and size of the printed circuit boards and insulating plates can be varied in accordance with manufacturing methods and the materials used as well as the specific requirements of a given application. For example, when alumina ceramic is used to fabricate the insulator plates, it may be preferred to use octagonal and rectangular profiles since these are less expensive than a circular shape. All metal interfacing surfaces are preferably tinned with solder and assembled by reflowing the solder with a hot plate, induction heater, oven or other suitable reflow soldering device. Any of the techniques used in the aforementioned Provisional Patent Application Ser. No. 60/033,349 can be used.

Any suitable materials can be used to fabricate the feed-through housing components and contacts including, but not limited to, aluminum, steel, brass or beryllium copper alloys.

The uninsulated air gaps between any of the metalized patterns within the header should preferably be at least 0.06 inch in order to prevent arcing during the high voltage firing pulse. In addition, as large an area as possible should preferably be maintained on the pattern overlaps in order to insure low resistance and adequate current carrying capability.

While twenty five unit component arrays have been described and illustrated, it will be appreciated that arrays of fewer or greater than twenty five components can be used when fabricating headers for the slapper detonator.

The slapper detonator and feed-through assembly according to the present invention can be configured to accommodate differential thermal expansion due to the different materials bonded as an integral unit. This is particularly true with respect to feed-through assemblies utilizing a ceramic insulator plate mounted in a steel or aluminum housing.

The components and assemblies according to the present invention can be applied to numerous types of military and commercial explosive devices.

While the slapper detonator and feed-through assembly according to the present invention have been shown in a particular orientation and described using terms such as "top" and "bottom," it will be appreciated that such terminology is used only to provide a point of reference for understanding the invention and should not be construed as limiting use of the invention to any particular orientation. For example, the slapper detonator can be oriented such that the input contacts extend upwardly, downwardly, or at any angle relative to horizontal.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A slapper detonator comprising a detonator housing having first and second ends;

an explosive pellet disposed within said detonator housing adjacent said first end;

a bridge chip including a surface with a metalized portion defining a pair of contact pads connected by a bridge element, and a flyer disposed between said bridge element and said explosive pellet;

a header assembly including a first printed circuit board disposed between said bridge chip and said explosive pellet, a second printed circuit board disposed between said bridge chip and said second end of said detonator housing, and a pocket defined between said first and second printed circuit boards for receiving said bridge chip;

said second printed circuit board including a first surface with a pair of metalized pads facing said first printed circuit board and a second surface with a pair of metalized pads connected with said pads on said first surface; and said first printed circuit board including a first surface with a pair of metalized pads facing said second printed circuit board, each metalized pad of said first printed circuit board overlapping a contact pad of said bridge chip and a metalized pad on said first surface of said second printed circuit board to create a connection therebetween and with said metalized pads on said second surface of said second printed circuit board.

2. A slapper detonator as recited in claim 1 wherein said pocket is formed in said second printed circuit board.

3. A slapper detonator as recited in claim 1 wherein said pocket is formed by a third printed circuit board with an opening disposed between said first and second printed circuit boards.

4. A slapper detonator as recited in claim 1 wherein said second printed circuit board defines a barrel opening over said bridge for said flyer to accelerate through before impacting said explosive pellet.

5. A slapper detonator as recited in claim 1 and further comprising a plurality of contact pins mounted on said metalized pads on said second surface of said second printed circuit board.

6. A slapper detonator as recited in claim 1 and further comprising an adapter board disposed between said second printed circuit board and said second end of said detonator housing, said adapter board including a first surface with a pair of metalized pads contacting said metalized pads on said second surface of said second printed circuit board and a second surface with a centrally disposed inner metalized pad connected with one of said metalized pads on said first surface and a concentric ring-shaped outer metalized pad connected to the other of said metalized pads on said first surface.

7. A slapper detonator as recited in claim 6 and further comprising coaxial contacts connected with said inner and outer pads on said second surface of said adapter board.

8. A slapper detonator as recited in claim 1 wherein said bridge chip is adhered to said second printed circuit board.

9. In combination, a slapper detonator as recited in claim 5 and a feed-through assembly comprising a feed-through housing adapted to mate in hermetically sealed relation to a fuze housing and a plurality of contact sockets carried by said feed-through housing to receive said pin contacts in a detachable manner.

10. In combination, a slapper detonator as recited in claim 7 and a feed-through assembly comprising a feed-through housing adapted to mate in hermetically sealed relation to a fuze housing and a coaxial contact set adapted to mate detachably with said coaxial contact set on said adapter board.

11. A method of manufacturing a slapper detonator comprising the steps of defining a pair of metalized pads on one side of a first printed circuit board;

defining a pair of metalized pads on each side of a second printed circuit board;

connecting each of the metalized pads on the second printed circuit board with a metalized pad on the opposite side of the second board;

defining a pocket between the first and second printed circuit boards;

placing a bridge chip with contact pads connected by a bridge element in the pocket;

positioning each of the metalized pads on the first printed circuit board over a bridge contact pad and a metalized pad on an opposed surface of the second printed circuit board to establish a connection between the bridge contact pad and a metalized pad on an opposite side of the second printed circuit board; and reflowing solder between the metalized pads.

12. A method of manufacturing a slapper detonator as recited in claim 11 wherein said pocket defining step includes forming a pocket in the second printed circuit board.

13. A method of manufacturing a slapper detonator as recited in claim 11 wherein said pocket defining step includes positioning a third printed circuit board with an opening therethrough between said first and second printed circuit boards.

14. A method of manufacturing a slapper detonator as recited in claim 11 and further comprising the step of attaching a plurality of contact pins to metalized pads on a surface of the second printed circuit board.

15. A method of manufacturing a slapper detonator as recited in claim 11 and further comprising, prior to said solder reflowing step, the steps of positioning an adapter board with pairs of metalized pads on each side against the second printed circuit board to connect the metalized pads on the second printed circuit board with concentrically arranged metalized pads of ring-like configuration on the side of the adapter board opposite the second board.

16. A method of manufacturing a slapper detonator as recited in claim 15 and further comprising the step of attaching a coaxial contact set to the concentric pads on the adapter board.

17. A method of manufacturing a slapper detonator as recited in claim 11 and further comprising the step of defining an opening through the first printed circuit board above the bridge to permit a flyer positioned over the bridge to accelerate before impacting an explosive pellet.

18. A method of manufacturing a slapper detonator as recited in claim 11 and further comprising the step of adhering the bridge chip to the first printed circuit board.

* * * * *